US008918010B2

(12) United States Patent
Tamura

(10) Patent No.: US 8,918,010 B2
(45) Date of Patent: Dec. 23, 2014

(54) IMAGE FORMING APPARATUS

(71) Applicant: KYOCERA Document Solutions Inc., Osaka (JP)

(72) Inventor: Yuki Tamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/902,696

(22) Filed: May 24, 2013

(65) Prior Publication Data

US 2013/0322916 A1 Dec. 5, 2013

(30) Foreign Application Priority Data

May 31, 2012 (JP) ..... 2012-124311

(51) Int. Cl.
*G03G 21/00* (2006.01)
*G03G 21/16* (2006.01)

(52) U.S. Cl.
CPC ..... *G03G 21/169* (2013.01); *G03G 21/1633* (2013.01); *G03G 21/1647* (2013.01)
USPC ..... 399/98

(58) Field of Classification Search
CPC ..... G03G 15/325; G03G 21/16; G03G 21/10
USPC ..... 399/98
See application file for complete search history.

(56) References Cited

U.S. PATENT DOCUMENTS

2008/0025747 A1* 1/2008 Lim ..... 399/71

FOREIGN PATENT DOCUMENTS

| | | | |
|---|---|---|---|
| JP | S62-231971 | A | 10/1987 |
| JP | S64-13060 | U | 1/1989 |
| JP | H09-054484 | A | 2/1997 |
| JP | H09-244362 | A | 9/1997 |
| JP | 2000-321519 | A | 11/2000 |
| JP | 2002-365864 | A | 12/2002 |
| JP | 2004-085899 | A | 3/2004 |
| JP | 2005-192076 | A | 7/2005 |
| JP | 2006-187933 | A | 7/2006 |
| JP | 2006-208848 | A | 8/2006 |
| JP | 2006-215225 | A | 8/2006 |
| JP | 2007-011121 | A | 1/2007 |
| JP | 2007-041270 | A | 2/2007 |
| JP | 2009-288599 | A | 12/2009 |

OTHER PUBLICATIONS

An Office Action; "Notice of Reasons for Rejection," issued by the Japanese Patent Office on Jun. 3, 2014, which corresponds to Japanese Patent Application No. 2012-124311 and is related to U.S. Appl. No. 13/902,696.

An Office Action; "Notice of Reasons for Rejection," issued by the Japanese Patent Office on Aug. 5, 2014, which corresponds to Japanese Patent Application No. 2014-127870 and is related to U.S. Appl. No. 13/902,696.

* cited by examiner

*Primary Examiner* — Walter L Lindsay, Jr.
*Assistant Examiner* — Barnabas Fekete
(74) *Attorney, Agent, or Firm* — Studebaker & Brackett PC

(57) ABSTRACT

An image forming apparatus is provided. The image forming apparatus includes an outer housing, a cover openeably/closably mounted at the outer housing, an optical scanning device including a light transmissive member configured to transmit laser light, a cleaning member configured to clean the light transmissive member, and an interlocking mechanism. The interlocking mechanism moves the cleaning member in conjunction with opening/closing of the cover.

5 Claims, 16 Drawing Sheets

IMAGE FORMING APPARATUS

INCORPORATION BY REFERENCE

The present application claims priority under 35 U.S.C. §119 to Japanese Patent Application No. 2012-124311, filed May 31, 2012. The contents of this application are incorporated herein by reference in their entirety.

BACKGROUND

The present disclosure relates to image forming apparatuses to form an image on a sheet and particularly relates to an image forming apparatus including an optical scanning device to form an electrostatic latent image on an image carrier.

For image forming apparatuses that form an image on a sheet, optical scanning devices to form an electrostatic latent image on a photosensitive drum that carries an image have been known. In this technique, an exposure device as an optical scanning device includes, inside its housing, a laser diode, a lens, a polygon mirror, a polygon motor, an fθ lens, a steering mirror, a light transmissive member having a dust-proof function.

Laser light emitted from the laser diode is guided to the polygon mirror through the lens. Then, the light laser entering the polygon mirror that is driven and rotated by the polygon motor is reflected and deflected by the mirror surface of the polygon mirror, passes through the fθ lens, and is then reflected by the steering mirror. The laser light reflected by the steering mirror is guided to the dram surface of the photosensitive drum that is rotated in the sub scanning direction, while being scanned in the main scanning direction through the transparent light transmissive member.

For example, some exposure device further includes a shielding member that covers the light transmissive member. The shielding member is movable between a position where the light transmissive member is covered and a position where the light transmissive member is exposed. In the case where an image forming apparatus has an openable outer cover, covering the light transmissive member with the shielding member can prevent the laser light from being emitted outside the image forming apparatus. Further, in the aforementioned exposure device, a cleaning member capable of cleaning the light transmissive member is mounted at the shielding member. When the shielding member moves to the position where the light transmissive member is covered, the cleaning member comes into contact with the light transmissive member, thereby removing toner and dust adhering to the light transmissive member.

SUMMARY

According to the present disclosure, an image forming apparatus is provided. The image forming apparatus includes an outer housing, a cover openeably/closably mounted at the outer housing, an optical scanning device including a light transmissive member configured to transmit laser light, a cleaning member configured to clean the light transmissive member, and an interlocking mechanism. The interlocking mechanism moves the cleaning member in conjunction with opening/closing of the cover.

DETAILED DESCRIPTION

Figure 1:
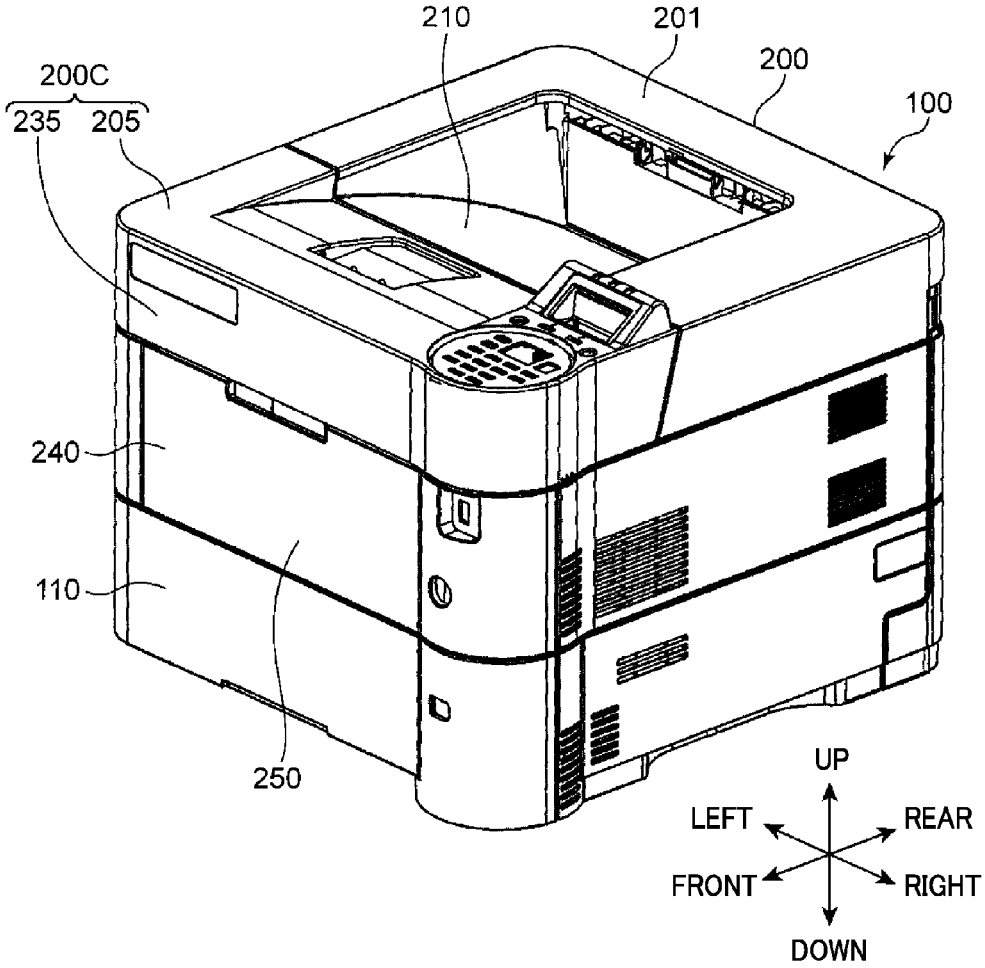
FIG. 1 is a perspective view of an image forming apparatus according to one embodiment of the present disclosure and shows the state when an openable/closable cover is closed.
Figure 2:
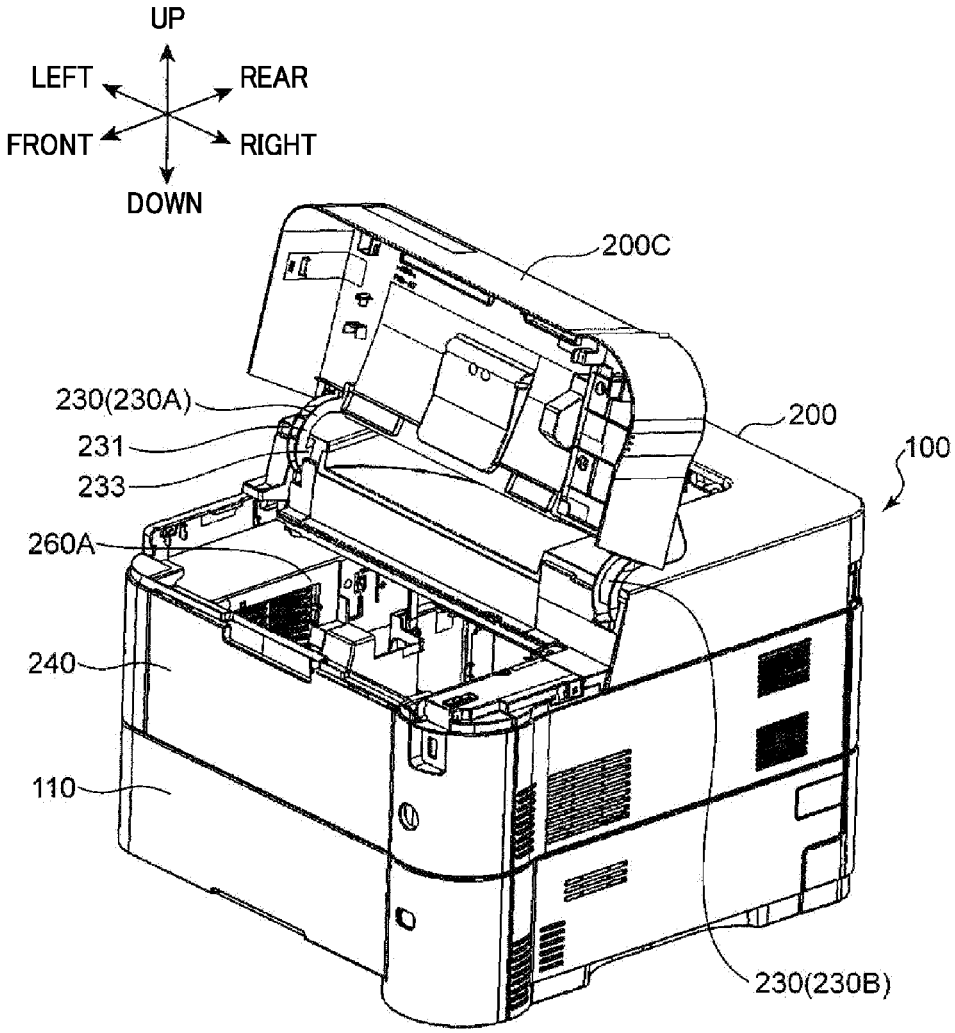
FIG. 2 is a perspective view of the image forming apparatus according to one embodiment of the present disclosure and shows the state when the openable/closable cover is opened.
Figure 3:
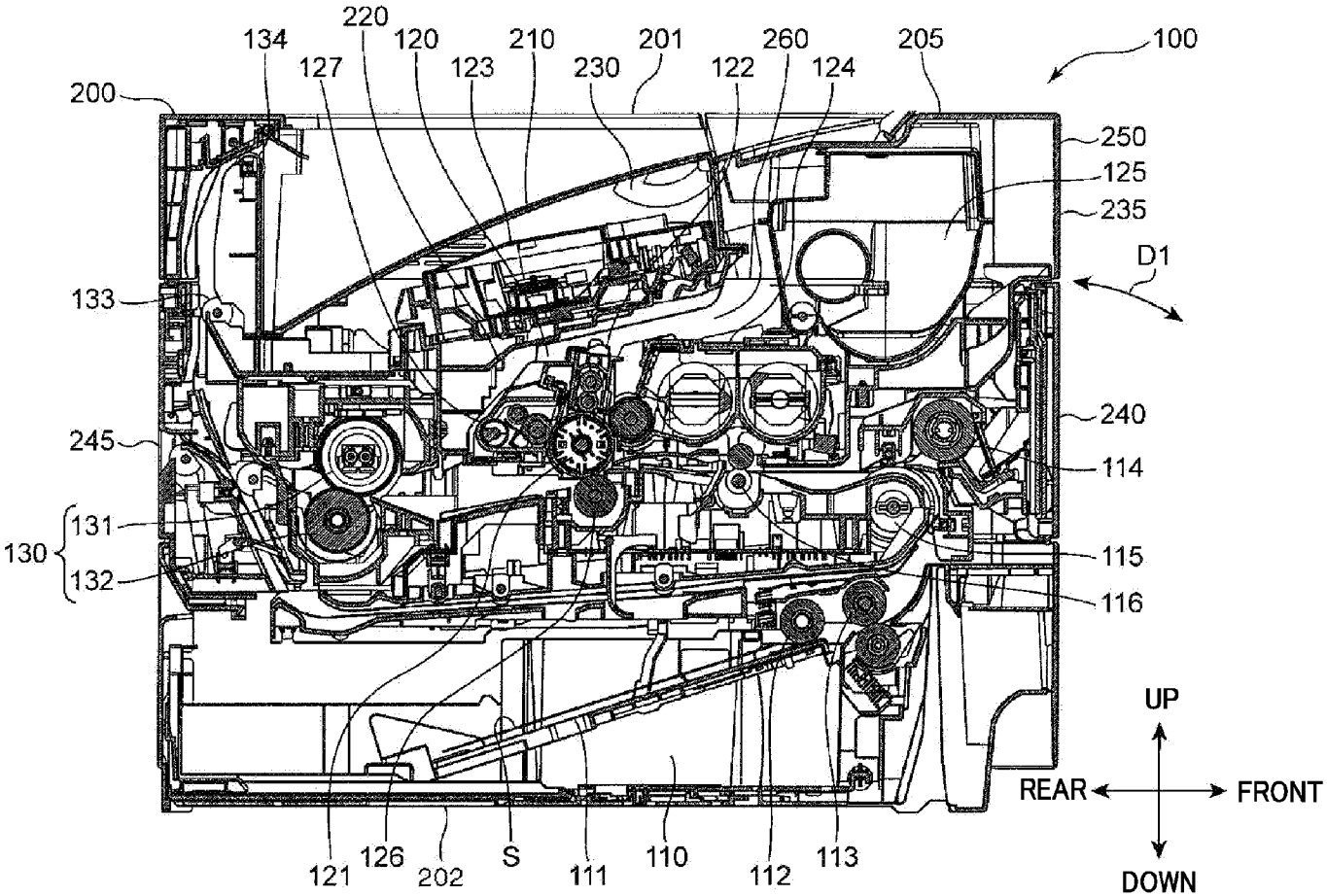
FIG. 3 is a cross sectional view schematically showing an internal configuration of the image forming apparatus according to one embodiment of the present disclosure.

Embodiments of the present disclosure will be described below with reference to the accompanying drawings. FIG. 1 is a perspective view of a printer 100 (an image forming apparatus) according to one embodiment of the present disclosure. FIG. 2 is a perspective view showing a state when an openable/closable cover 200C is opened upward in the printer 100. Further, FIG. 3 is a cross sectional view showing an internal configuration of the printer 100 shown in FIGS. 1 and 2. The printer 100 shown in FIGS. 1-3 is generally called a monochrome printer. However, the image forming apparatus may be a color printer, a facsimile machine, a multifunction peripheral having these functions, or any other apparatus that forms a toner image on a sheet in other embodiments. It is noted that the terms that express directions, such as "up", "down", "front", "rear", "right", and "left" are used merely for the purpose of clarification of the description and are not intended to limit any principles of the image forming apparatus.

The printer 100 includes an outer housing 200 configured to accommodate various devices for forming an image on a sheet S. The outer housing 200 includes an upper wall 201, which defines the upper surface of the outer housing 200, a bottom wall 202 (FIG. 3), which defines the bottom surface of the outer housing 200, a rear wall 245 (FIG. 3), which is formed between the upper wall 201 and the bottom wall 202, and a front wall 250, which is positioned in front of the rear wall 245. The outer housing 200 forms a main body interior space 260 (an interior space) in which various devices are disposed. As show in in FIG. 2, a main body opening 260A, which is open upward to the main body interior space 260, is formed in an upper front part of the outer housing 200. The openable/closable cover 200C is mounted at the outer housing 200 so as to freely open/close the main body opening 260A.

A copy receiving tray 210 is formed at the central part of the upper wall 201. The copy receiving tray 210 is formed of an inclined surface that is inclined downward from the front part to the rear part of the upper wall 201. The sheet S on which an image is formed in an image forming section 120, which will be described later, is ejected onto the copy receiving tray 210. Further, a manual feed tray 240 is provided at the central part in the vertical direction of the front wall 250. The manual feed tray 240 is vertically turnable about its lower end as a pivot (in the direction indicated by the arrow D1 in FIG. 3).

The openable/closable cover 200C is openable/closable vertically about hinge portions, which will be described later, as pivot points through a pair of arm portions 230 (230A and 230B) arranged at its opposite ends in the right and left directions (FIGS. 1 and 2). When the openable/closable cover 200C is opened, the main body interior space 260 is open outside through the main body opening 260A. By contrast, when the openable/closable cover 200C is closed, the main body interior space 260 is blocked.

The printer 100 includes a cassette 110, a pickup roller 112, a first paper feed roller 113, a second the paper feed roller 114, a conveyance roller 115, a registration roller pair 116, and an image forming section 120.

The cassette 110 accommodates the sheet S therein. The cassette 110 includes a lift plate 111 that supports the sheet S. The lift plate 111 inclines so as to lift up the leading edge of the sheet S. The pickup roller 112 is arranged on the side of the leading edge of the sheet S lifted up by the lift plate 111. When the pickup roller 112 rotates, the sheet S is drawn out from the cassette 110.

The first paper feed roller 113 is arranged downstream of the pickup roller 112. The first paper feed roller 113 sends out the sheet S further downstream. The second paper feed roller 114 is arranged in the vicinity of the pivot of the manual feed tray 240. The second paper feed roller 114 draws the sheet S on the manual feed tray 240 into the outer housing 200. The user can selectively use the sheet S accommodated in the cassette 110 or the sheet S placed on the manual feed tray 240.

The conveyance roller 115 is arranged downstream of the first paper feed roller 113 and the second paper feed roller 114 (hereinafter, it may be referred to merely as downstream) in a sheet conveyance direction (hereinafter, it may be referred to merely as a conveyance direction). The conveyance roller 115 conveys the sheet S sent out by the first paper feed roller 113 and the second paper feed roller 114 further downstream.

The registration roller pair 116 has a function of correcting skew conveyance of the sheet S. The function of the registration roller pair 116 can adjust the position of an image to be formed on the sheet S. The registration roller pair 116 supplies the sheet S to the image forming section 120 at the timing of image formation by the image forming section 120.

The image forming section 120 includes a photosensitive drum 121 (an image carrier), a charger 122, an exposure device 123 (an optical scanning device), a developing device 124, a tonner container 125, a transfer roller 126, and a cleaning device 127.

The photosensitive drum 121 is substantially cylindrical in shape. An electrostatic latent image is formed on the peripheral surface of the photosensitive drum 121. The photosensitive drum 121 carries a toner image based on the electrostatic latent image.

Given voltage is applied to the charger 122, so that the charger 122 electrostatically charges the peripheral surface of the photosensitive drum 121 substantially uniformly.

The exposure device 123 irradiates laser light to the peripheral surface of the photosensitive drum 121 which is electrostatically charged by the charger 122. The laser light is irradiated according to image data output from an external device (not shown), such as a personal computer, communicably connected to the printer 100. Thus, an electrostatic latent image corresponding to the image data is formed on the peripheral surface of the photosensitive drum 121. It is noted that the exposure device 123 will be described later in detail.

The developing device 124 supplies toner to the peripheral surface of the photosensitive drum 121 on which the electrostatic latent image is formed. The tonner container 125 supplies the toner to the developing device 124 sequentially or as needed. When the developing device 124 supplies the toner to the photosensitive drum 121, the electrostatic latent image formed on the peripheral surface of the photosensitive drum 121 is developed (visualized). Thus, the toner image is formed on the peripheral surface of the photosensitive drum 121.

The transfer roller 126 is arranged rotatably so as to be in contact with the peripheral surface of the photosensitive drum 121. When the sheet S conveyed from the registration roller pair 116 passes between the photosensitive drum 121 and the transfer roller 126, the toner image formed on the peripheral surface of the photosensitive drum 121 is transferred to the sheet S.

The cleaning device 127 removes toner remaining on the peripheral surface of the photosensitive drum 121 after transfer of the toner image to the sheet S. The peripheral surface of photosensitive drum 121, which is cleaned by the cleaning device 127, passes below the charger 122 again to be electrostatically charged uniformly. Thereafter, formation of a toner image as described above is performed anew.

The printer 100 further includes a fusing device 130 configured to fuse the toner image to the sheet S. The fusing device 130 is arranged downstream of the image forming section 120 in the conveyance direction. The fusing device 130 includes a heating roller 131 configured to melt the toner on the sheet S and a pressure roller 132 configured to make the sheet S adhere to the heating roller 131. When the sheet S passes between the heating roller 131 and the pressure roller 132, the toner image is fused to the sheet S.

The printer 100 further includes a plurality of conveyance roller pairs 133 arranged downstream of the fusing device 130 and an ejection roller pair 134 arranged downstream of the conveyance roller pairs 133. The sheet S is conveyed upward by the conveyance roller pairs 133 and is finally ejected from the outer housing 200 by the ejection roller pair 134. The sheet S ejected from the outer housing 200 is stacked on the copy receiving tray 210.

Figure 4:
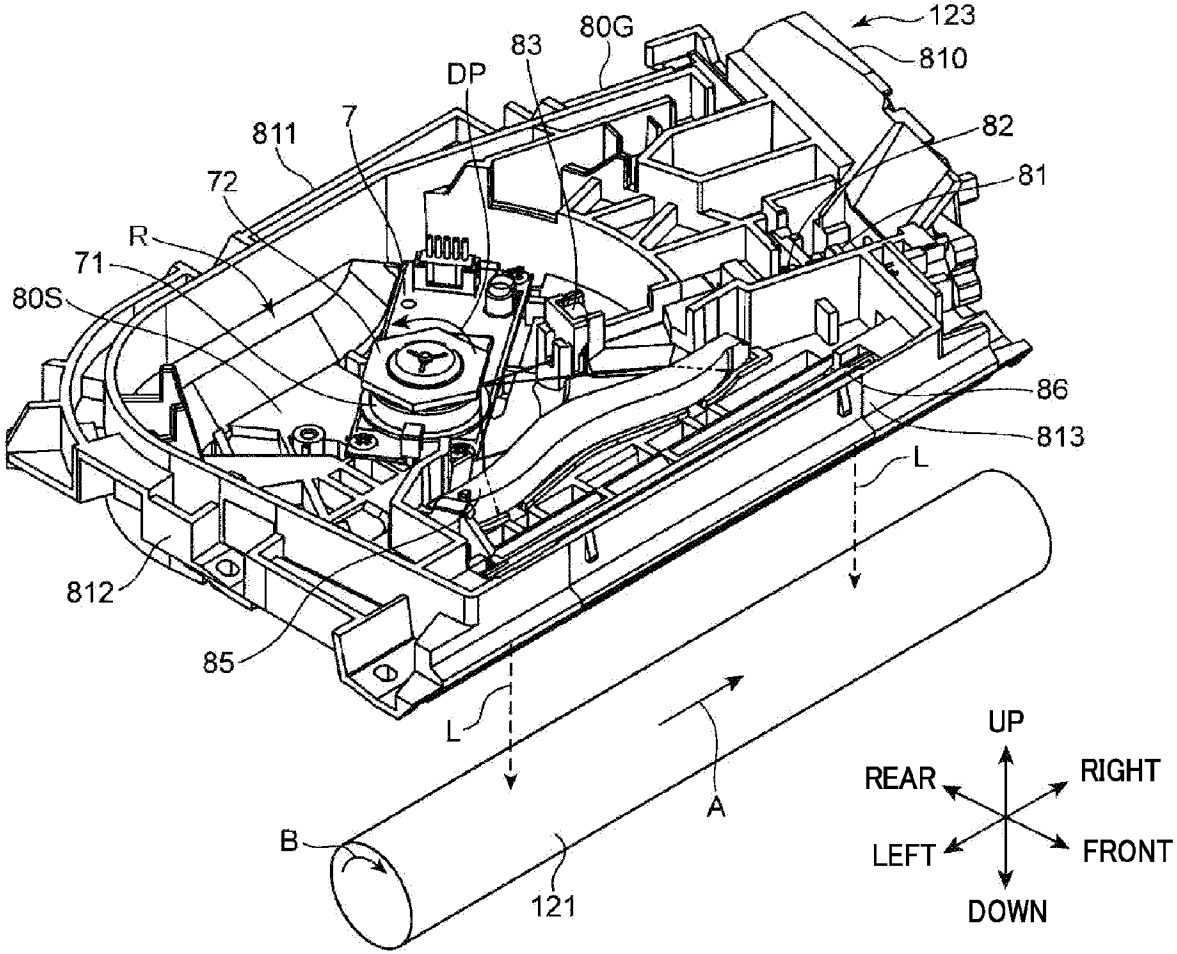
FIG. 4 is an inner perspective view of an exposure device according to one embodiment of the present disclosure.

With reference to FIG. 4, a configuration of the exposure device 123 according to the present embodiment will be described next. FIG. 4 is a perspective view showing an internal configuration of the exposure device 123 according to the present embodiment. It is noted that FIG. 4 shows the state when a top plate 80T (see FIGS. 5 and 8) of the exposure device 123 is taken off. The exposure device 123 is disposed in the main body interior space 260. That is, the exposure device 123 is disposed inside the outer housing 200. The exposure device 123 includes a housing 80 (see FIG. 8), a laser diode 81 (a laser light source), lens sections 82 and 83, a polygon motor unit 7, an fθ lens 85, and a steering mirror 86.

Figure 5:
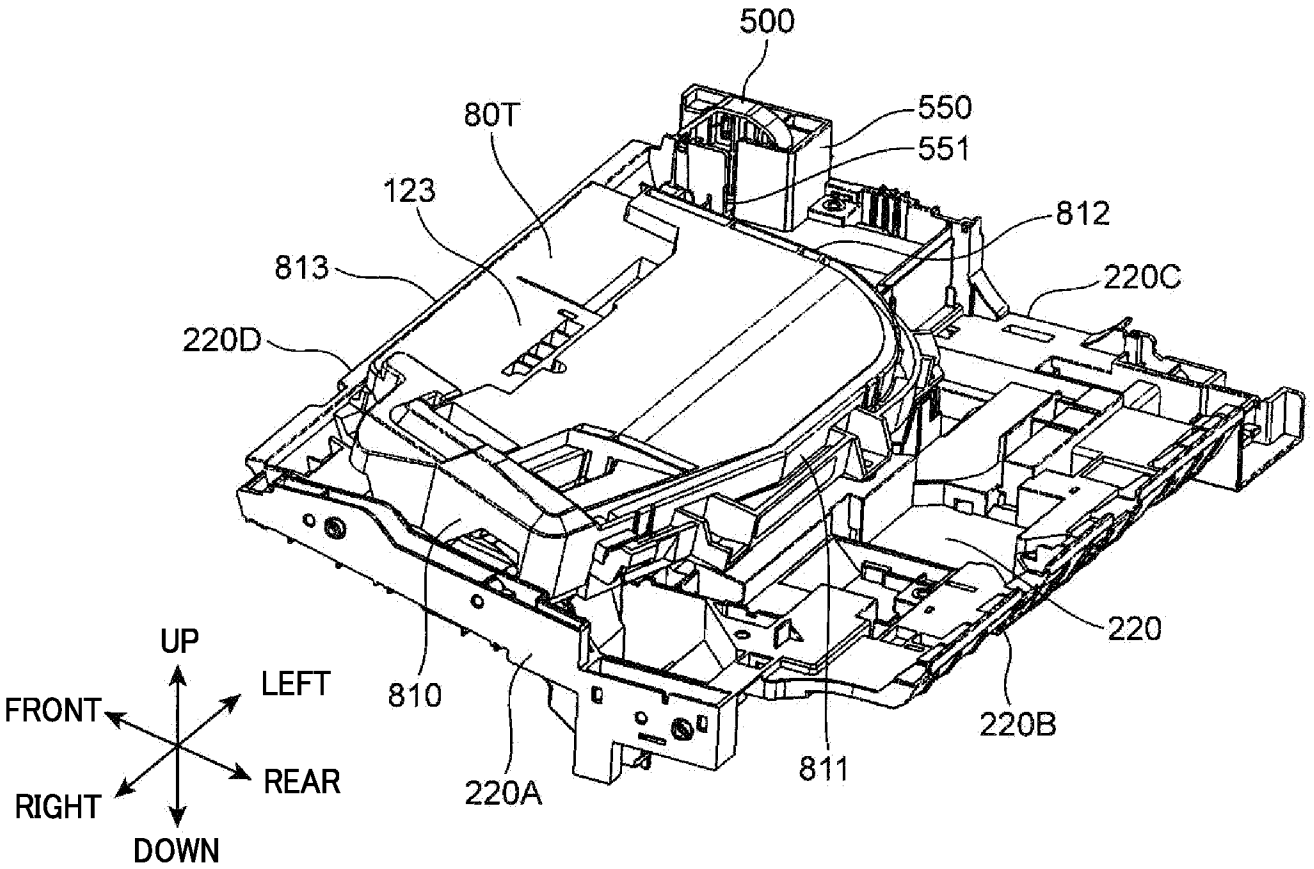
FIG. 5 is a perspective view showing a state in which the exposure device is fitted in a fitting part of the exposure device according to one embodiment of the present disclosure.
Figure 8:
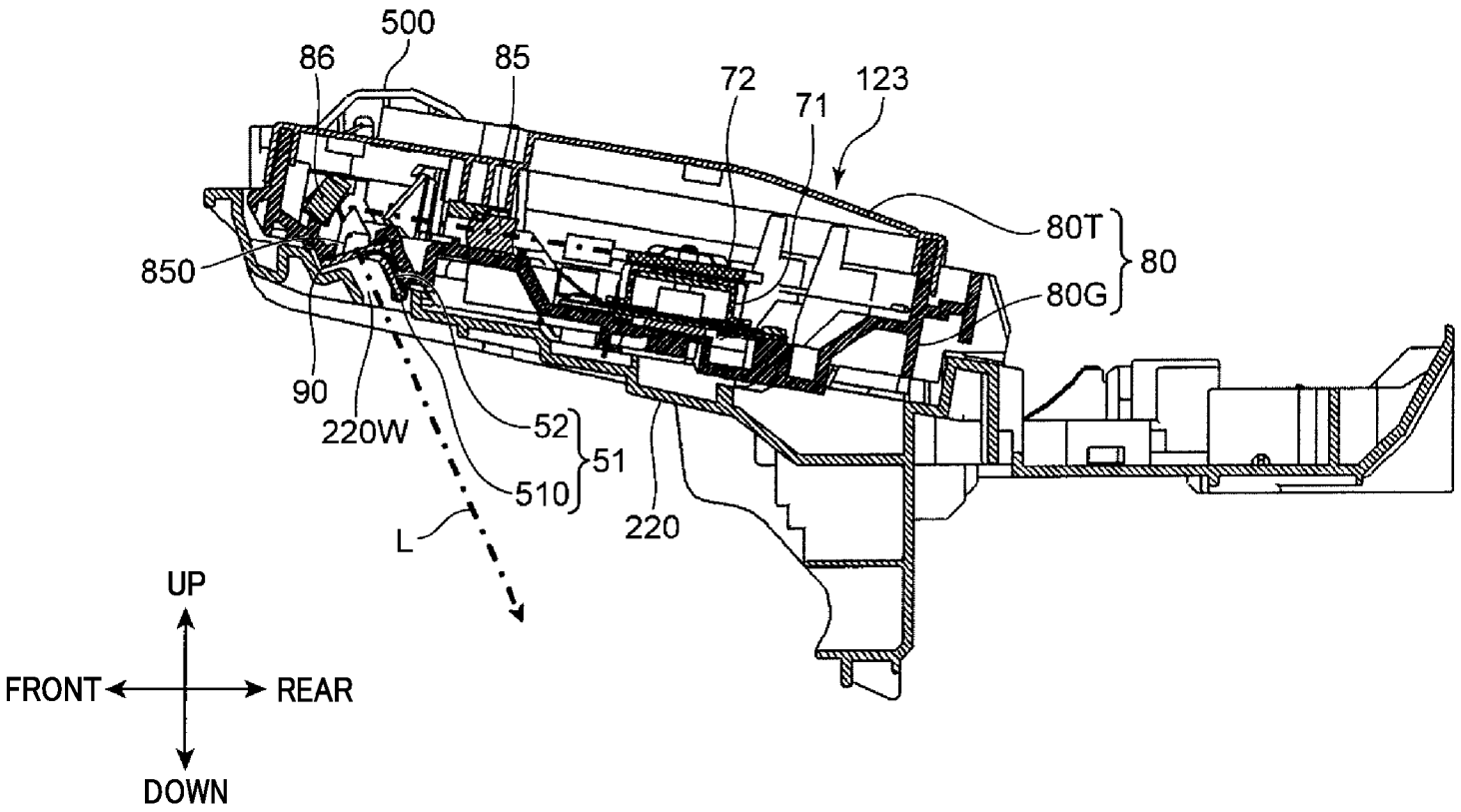
FIG. 8 is a cross sectional view of the exposure device according to one embodiment of the present disclosure.

The housing 80 is a box body that accommodates respective components of the exposure device 123. The housing 80 is a flat box body substantially rectangular in shape as viewed from above. The housing 80 includes a housing main body 80G and the top plate 80T (FIGS. 5 and 8). The right, rear, left, and front surfaces of the housing main body 80G are defined by a right wall 810, a rear wall 811, a left wall 812, and a front wall 813, respectively. Further, the bottom surface of the housing 80 is defined by a bottom portion 80S. The top plate 80T is fitted on the upper part of the housing main body 80G so as to be connected to the right wall 810, the rear wall 811, the left wall 812, and the front wall 813. Inside the housing 80, there is formed an interior space R, in which various optical components are provided.

The laser diode 81 emits (outputs) laser light according to an image data signal generated in and output from an image memory (not shown). The laser diode 81 is arranged on the right wall 810 inside the housing 80. The laser diode 81 is electrically connected to a circuit board (not shown) that controls timing of laser light emission and the like. Each lens section 82, 83 is composed of, for example, a collimating lens, a prism, or the like and has a function of converting the incident laser light to parallel light.

The polygon motor unit 7 is arranged substantially at the center of the housing 80. The polygon motor unit 7 includes, on its substrate, a polygon motor 71 and a polygon mirror 72. Upon input of drive electric current, the polygon motor 71 rotates the polygon minor 72 at predetermined number of rotations. The polygon mirror 72 is in a flat plate shape of a regular polygon (a regular hexagon in FIG. 4) in a plan view. The polygon mirror 72 includes a plurality of mirror surfaces. The polygon minor 72 is driven and rotated in a direction indicated by the arrow DP in FIG. 4. In other words, the polygon motor 71 rotates the polygon mirror 72 so that each mirror surface of the polygon mirror 72 faces the left wall 812 and faces then the front wall 813. The polygon mirror 72 deflects the laser light from the lens section 83 toward the fθ lens 85 for scan, while being rotated by the polygon motor 71.

The fθ lens 85 is arranged in the right and left directions in front of the polygon motor unit 7. The fθ lens 85 is arranged between the polygon motor 71 and the front wall 813. The fθ lens 85 is substantially in an arch-like shape as viewed from above. In particular, the central part of the fθ lens 85 protrudes toward the polygon mirror 72, while both the opposite end parts of the fθ lens 85 protrude toward the steering minor 86 (the front wall 813). The fθ lens 85 has a function of refracting the laser light deflected by the polygon mirror 72 for scan over the photosensitive drum 121 at a constant velocity. The steering mirror 86 is provided to reflect the laser light from the fθ lens 85 and guide it to the photosensitive drum 121.

Figure 9:
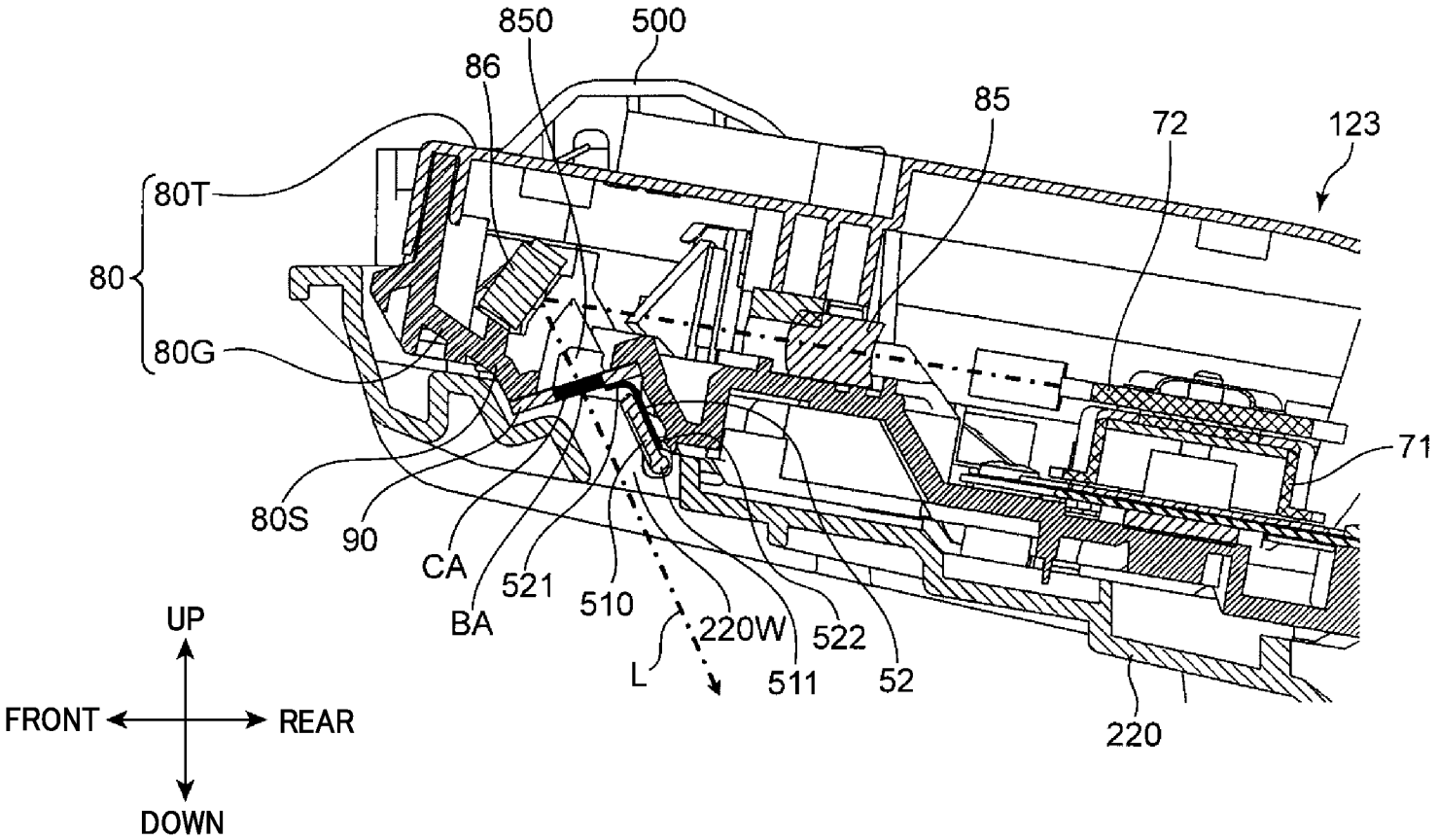
FIG. 9 is an enlarged cross sectional view showing the vicinity of the exposure device when the openable/closable cover is closed in the image forming apparatus according to one embodiment of the present disclosure.

At the bottom portion 80S of the housing 80, an emission opening 850 (an opening) is formed, as shown in FIGS. 8 and 9. The emission opening 850 is open to the steering minor 86 at a position at rear of and below the steering minor 86. The emission opening 850 has a predetermined width in the front-back direction and is arranged in the right and left directions (in a direction along the steering mirror 86). Through the emission opening 850, the laser light reflected by the steering minor 86 is emitted outside the exposure device 123.

The exposure device 123 according to the present embodiment further includes a seal glass 90 (a light transmissive member) that covers the emission opening 850 from below, as shown in FIGS. 8 and 9. The seal glass 90 is a transparent glass plate fixed to the bottom portion 80S and transmits the laser light passing through the emission opening 850. Further, the seal glass 90 has a function of preventing toner, dust, etc. from entering the exposure device 123. Hereinafter, a part of the outer surface of the seal glass 90 corresponding to the outer surface of the housing 80, which allows the laser light to pass through the seal glass 90, is referred to as an emission part BA.

In the exposure device 123, the laser light emitted from the laser diode 81 is guided to the polygon minor 72 through the lens sections 82, 83. Then, the laser light entering the rotating polygon mirror 72 is reflected and deflected by a mirror surface of the polygon mirror 72, passes through the fθ lens 85, and is then reflected by the steering mirror 86. The laser light reflected by the steering mirror 86 passes through the emission opening 850. The laser light passing through the emission opening 850 is transmitted through the seal glass 90 and is guided to the drum surface of the photosensitive drum 121, while being subjected to horizontal scanning in a predetermined scanning direction (a main scanning direction indicated by the arrow A in FIG. 4). The photosensitive drum 121 rotates about its axis orthogonal to the scanning direction (a sub scanning direction indicated by the arrow B in FIG. 4).

Figure 6:
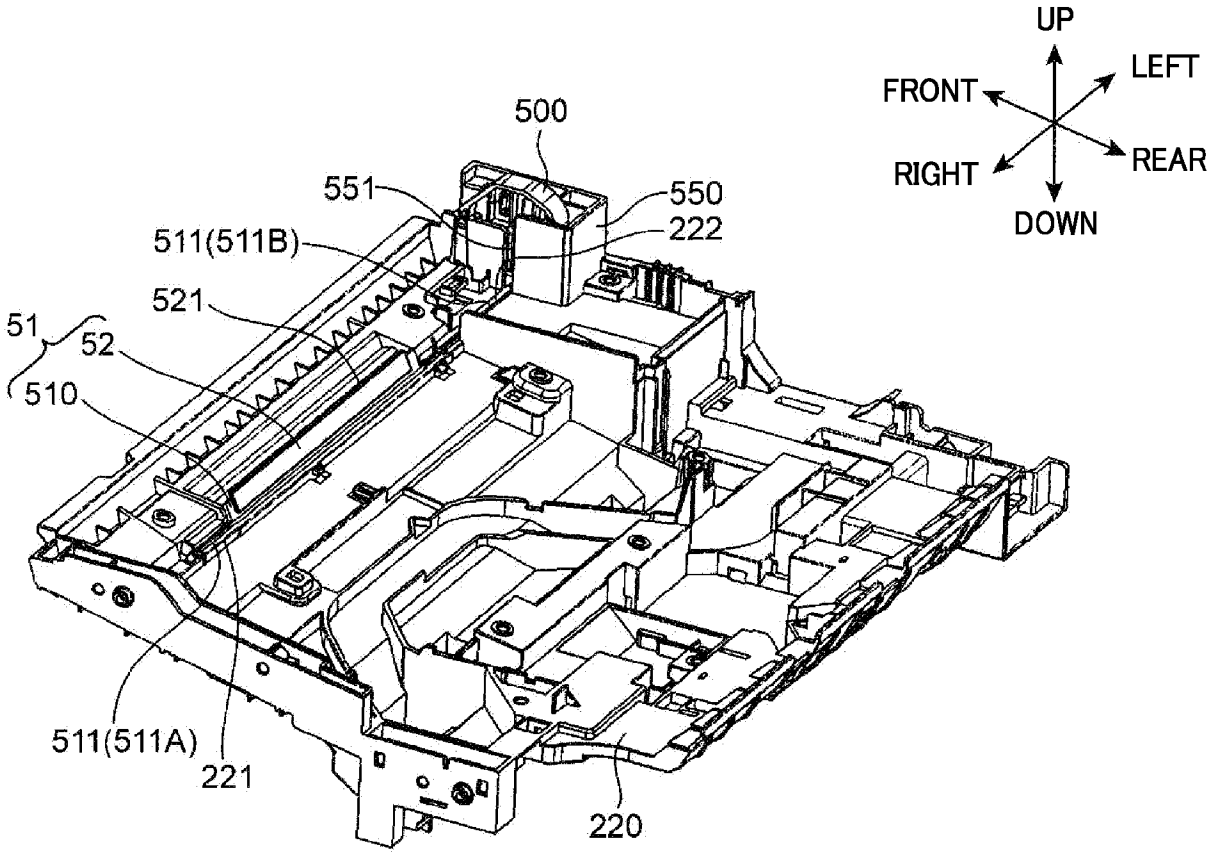
FIG. 6 is a perspective view showing the fitting part of the exposure device according to one embodiment of the present disclosure.
Figure 7:
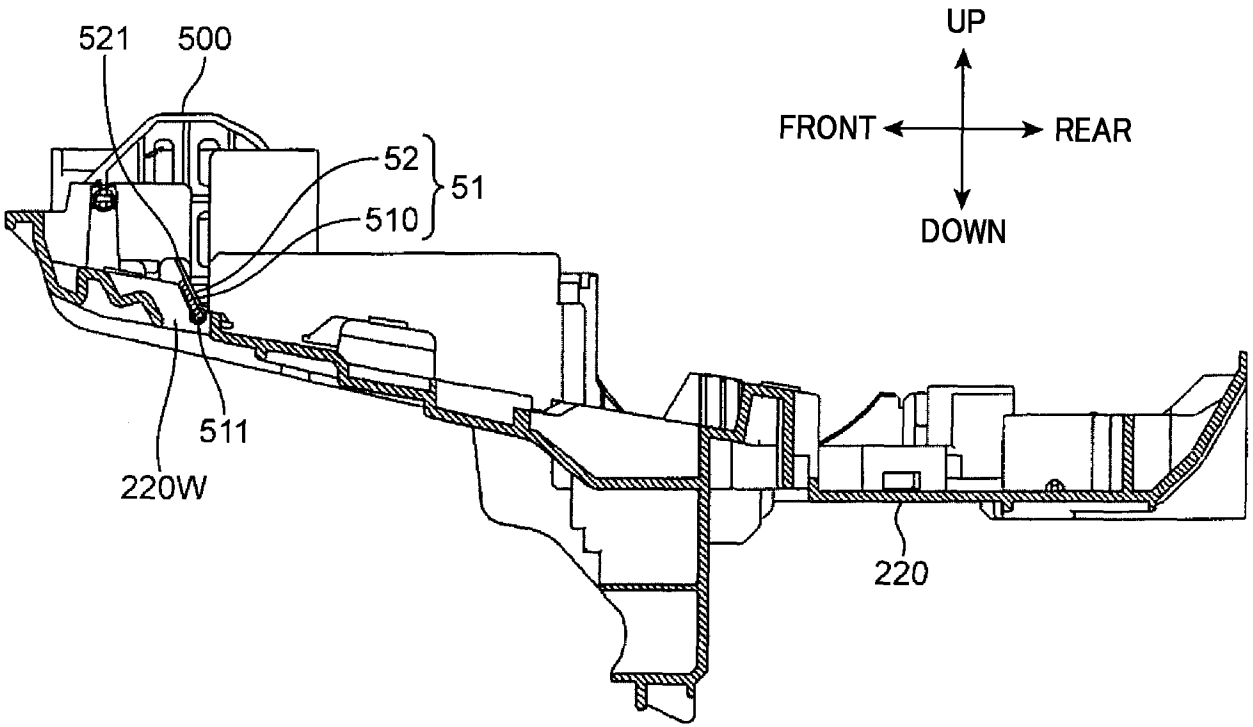
FIG. 7 is a cross sectional view showing the fitting part of the exposure device according to one embodiment of the present disclosure.
Figure 10:
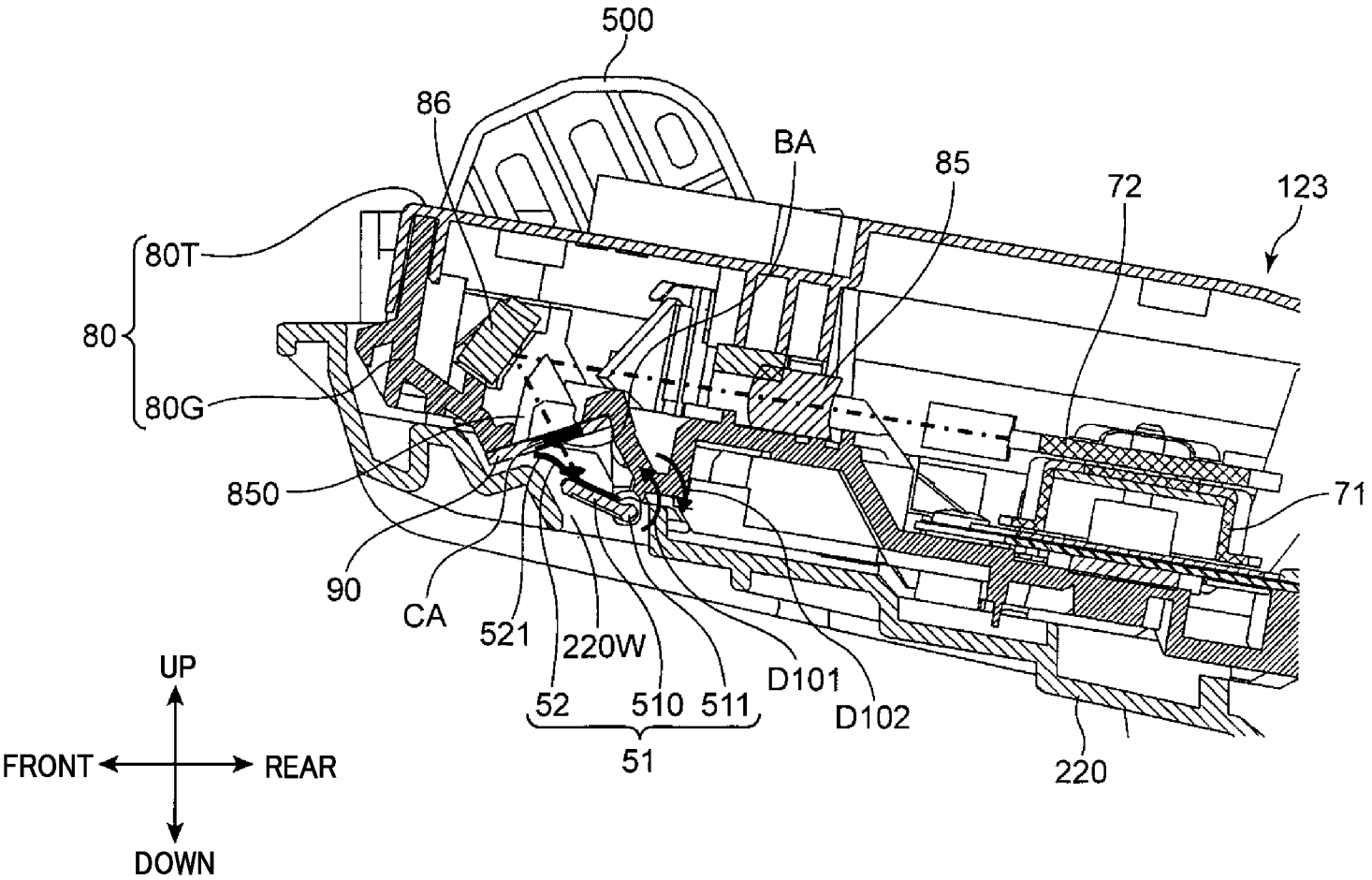
FIG. 10 is an enlarged cross sectional view of the vicinity of the exposure device when the openable/closable cover is opened in the image forming apparatus according to one embodiment of the present disclosure.

Description will be made next about a cleaning mechanism of the seal glass 90 in the exposure device 123. In the present embodiment, the cleaning mechanism of the seal glass 90 is arranged inside the outer housing 200. FIG. 5 is a perspective view showing the state in which the exposure device 123 is fitted in the outer housing 200. FIG. 6 is a perspective view showing the state in which the exposure device 123 is taken off from the fitting plate 220 shown in FIG. 5. FIG. 7 is a cross sectional view of a fitting plate 220 to which the exposure device 123 is fitted. FIG. 8 is a cross sectional view showing the state in which the exposure device 123 is fitted to the fitting plate 220. FIGS. 9 and 10 are enlarged cross sectional views (cross sectional views taken in a direction orthogonal to the right and left directions) showing the state in which the exposure device 123 is fitted to the fitting plate 220. FIG. 9 shows the state when the openable/closable cover 200C is closed. FIG. 10 shows the state when the openable/closable cover 200C is opened.

Referring to FIG. 5, the outer housing 200 of the image forming apparatus 1 includes the fitting plate 220. The fitting plate 220 is a support plate arranged substantially horizontally under the copy receiving tray 210 within the outer housing 200 (FIG. 3). The side edges in the front-back direction and the right and left directions of the fitting plate 220 are defined by a plate front wall 220D, a plate rear wall 220B, a plate left wall 220C, and a plate right wall 220A, respectively. The exposure device 123 is fitted to the fitting plate 220 from above. In so doing, the front wall 813, the rear wall 811, the left wall 812, and the right wall 810 of the exposure device 123 are positioned so as to correspond to the sides of the plate front wall 220D, the plate rear wall 220B, the plate left wall 220C, and the plate right wall 220A of the fitting plate 220, respectively.

Referring to FIGS. 7 and 8, an opening 220W is formed in the fitting plate 220. The opening 220W extends in the right and left directions so as to correspond to the seal glass 90 of the exposure device 123. When the exposure device 123 is fitted to the fitting plate 220 so that the emission opening 850 (the seal glass 90) is positioned above the opening 220W, the laser light (L in FIG. 4) can be irradiated to the photosensitive drum 121 from the exposure device 123 through the opening 220W.

When the image forming apparatus 1 performs image formation, the toner carried on the surface of the photosensitive drum 121 or the toner flying from the developing device 127 may float in the main body interior space 260. Further, in opening/closing the openable/closable cover 200C (FIG. 2), dust may enter the main body interior space 260. If the toner or dust floating in the main body interior space 260 adheres to the seal glass 90, it may shield the laser light emitted from the exposure device 123 to cause an image defect on an electrostatic latent image formed on photosensitive drum 121. In order to solve this problem, in the present embodiment, a cleaning member 51 is provided in the vicinity of the opening 220W of the fitting plate 220.

Referring to FIGS. 6-9, the cleaning member 51 is arranged at the fitting plate 220. The cleaning member 51 is arranged on the rear side of the opening 220W of the fitting plate 220. In a state in which the exposure device 123 is fitted to the fitting plate 220, the cleaning member 51 is positioned below the seal glass 90. The cleaning member 51 slides on the surface of the seal glass 90 corresponding to the outer surface of the housing 80 to clean the seal glass 90. More specifically, the cleaning member 51 cleans a to-be-cleaned region CA including the emission part BA of the surface of the seal glass 90 (FIG. 9). The cleaning member 51 includes a shielding portion 510 (a support member), a cleaning sheet 52 (a sheet member), and a shaft 511.

The shielding portion 510 corresponds to the main part of the cleaning member 51. The shielding portion 510 is a rectangular plate member with long sides extending in the right and left directions. The shielding portion 510 is made of a black resin material.

The cleaning sheet 52 is a rectangular sheet member with long sides extending in the right and left directions, which is attached to the upper surface of the shielding portion 510. In the present embodiment, the cleaning sheet 52 is a flexible sheet member made of, for example, urethane. As shown in FIGS. 9 and 10, a fixing portion 522, which is one end part in the short direction of the cleaning sheet 52 (a lower end part in FIGS. 9 and 10), is bonded and fixed to the shielding portion 510. Further, a tip end portion 521, which is the other end part in the short direction of the cleaning sheet 52 (an upper end part in FIGS. 9 and 10), extends upward from the shielding portion 510 to be a free end.

The shaft 511 is composed of one pair of shaft portions (a right shaft portion 511A and a left shaft portion 511B) respectively extending in the right direction and the left direction from respective ends (a lower end in FIG. 9) in the short direction of the shielding portion 510 (FIG. 6). That is, the shaft 511 is arranged at a position of the shielding portion 510 farthest from the seal glass 90 (opposite to the seal glass 90). The right shaft portion 511A and the left shaft portion 511B are inserted in a right bearing 211 and a left bearing 222 formed in the fitting plate 220 in the right and left directions, respectively. Accordingly, the cleaning member 51 is turnable about the shaft 511 as a pivot.

Hereinafter, as shown in FIG. 9, a position where the tip end portion 521 of the cleaning sheet 52 of the cleaning member 51 is positioned on the rearmost side is referred to as a first position of the cleaning member 51 in the present specification. Although it will be described later in detail, the first position is a position of the cleaning member 51 when the openable/closable cover 200C is closed. At the first position, the shielding portion 510 of the cleaning member 51 is positioned so as to be substantially orthogonal to the seal glass 90. The cleaning sheet 52 is bent frontward at a point near the upper end of the shielding portion 510. The tip end portion 521 of the cleaning sheet 52 is in contact with a region outside (at the rear of) the to-be-cleaned region CA of the surface of the seal glass 90.

Accordingly, when the cleaning member 51 is set at the first position, the tip end portion 521 of the cleaning sheet 52 uncovers the emission part BA of the seal glass 90. In other words, the tip end portion 521 is positioned away from the emission part BA. That is, the cleaning member 51 is positioned rearwardly away from a light path L of the laser light passing through the seal glass 90 without shielding the light path L of the laser light passing through the seal glass 90. Accordingly, the laser light reflected by the steering mirror 86 and passing through the seal glass 90 via the emission opening 850 can be irradiated to the photosensitive drum 121 through the opening 220W.

By contrast, as shown in FIG. 10, a position where the tip end portion 521 is positioned frontward of the emission part BA after the shielding portion 510 of the cleaning member 51 is turned about the shaft 511 as a pivot is referred to as a second position of the cleaning member 51. At the second position, the tip end portion 521 of the cleaning sheet 52 of the cleaning member 51 is in contact with the to-be-cleaned region CA of the seal glass 90 before the emission part BA (the tip end 512 is in contact with the front edge of the to-be-cleaned region CA in FIG. 10). In movement in which the cleaning member 51 moves from the first position to the second position, the tip end portion 521 of the cleaning sheet 52 slides on the surface (the to-be-cleaned region CA) of the seal glass 90 corresponding to the outer surface of the housing 80. Thus, the seal glass 90 can be cleaned preferably. Even where toner or dust adheres to the seal glass 90, the tip end portion 521 of the cleaning sheet 52 can scrape off the toner or dust from the seal glass 90. Further, when the cleaning member 51 is set at the second position, the shielding portion 510 of the cleaning member 51 is positioned across the light path L of the laser light passing through the seal glass 90. Thus, the cleaning member 51 can shield the laser light passing through the seal glass 90.

As described above, movement of the cleaning member 51 between the first position and the second position enables the tip end portion 521 of the cleaning sheet 52 to clean the to-be-cleaned region CA including the emission part BA of the seal glass 90. Incidentally, provision of a drive means, such as a drive motor is provided in order to move the cleaning member 51 may lead to increase in size and cost of the printer 100. However, the printer 100 according to the present embodiment further includes an interlocking mechanism 60. The interlocking mechanism 60 is configured to move the cleaning member 51 between the first position and the second position in conjunction with opening/closing of the openable/closable cover 200C.

Figure 11:
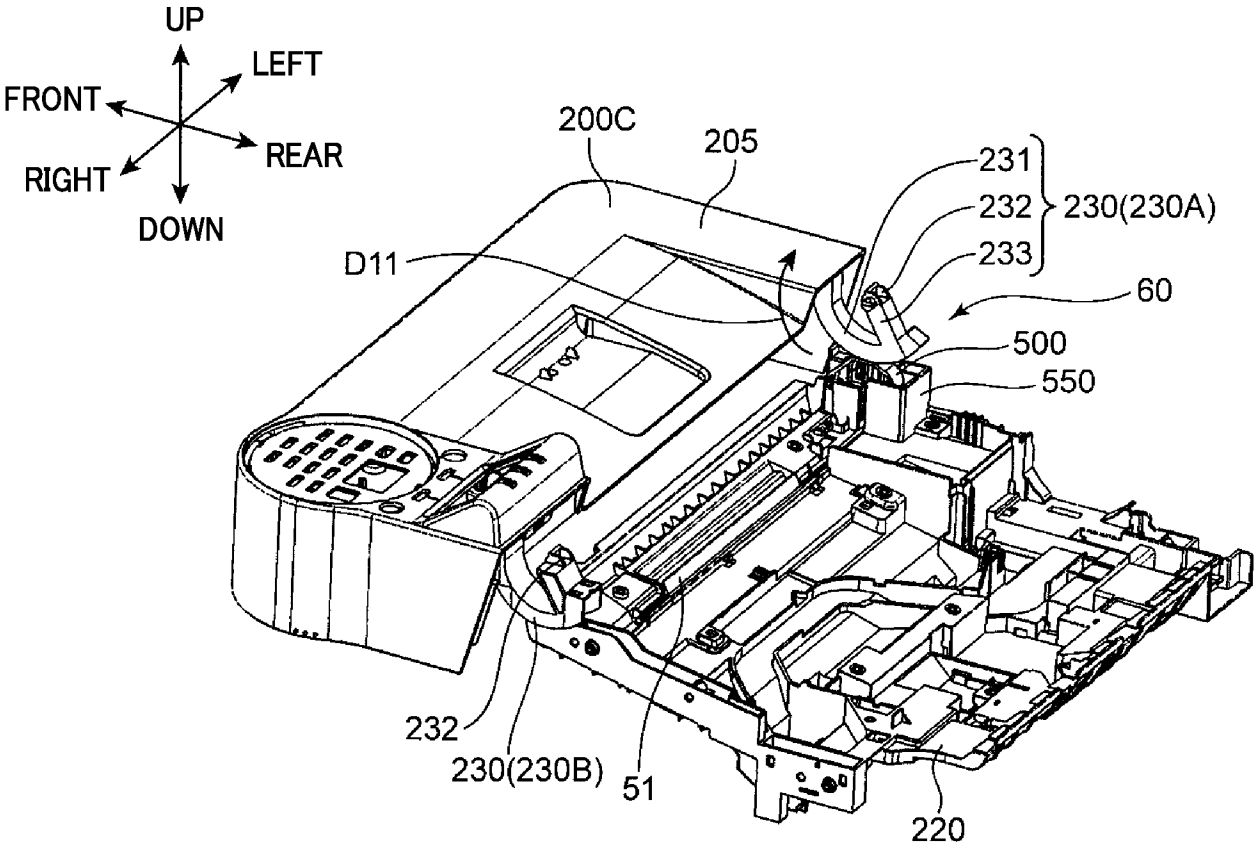
FIG. 11 is a perspective view showing the fitting part of the exposure device and the openable/closable cover according to one embodiment of the present disclosure.
Figure 12:
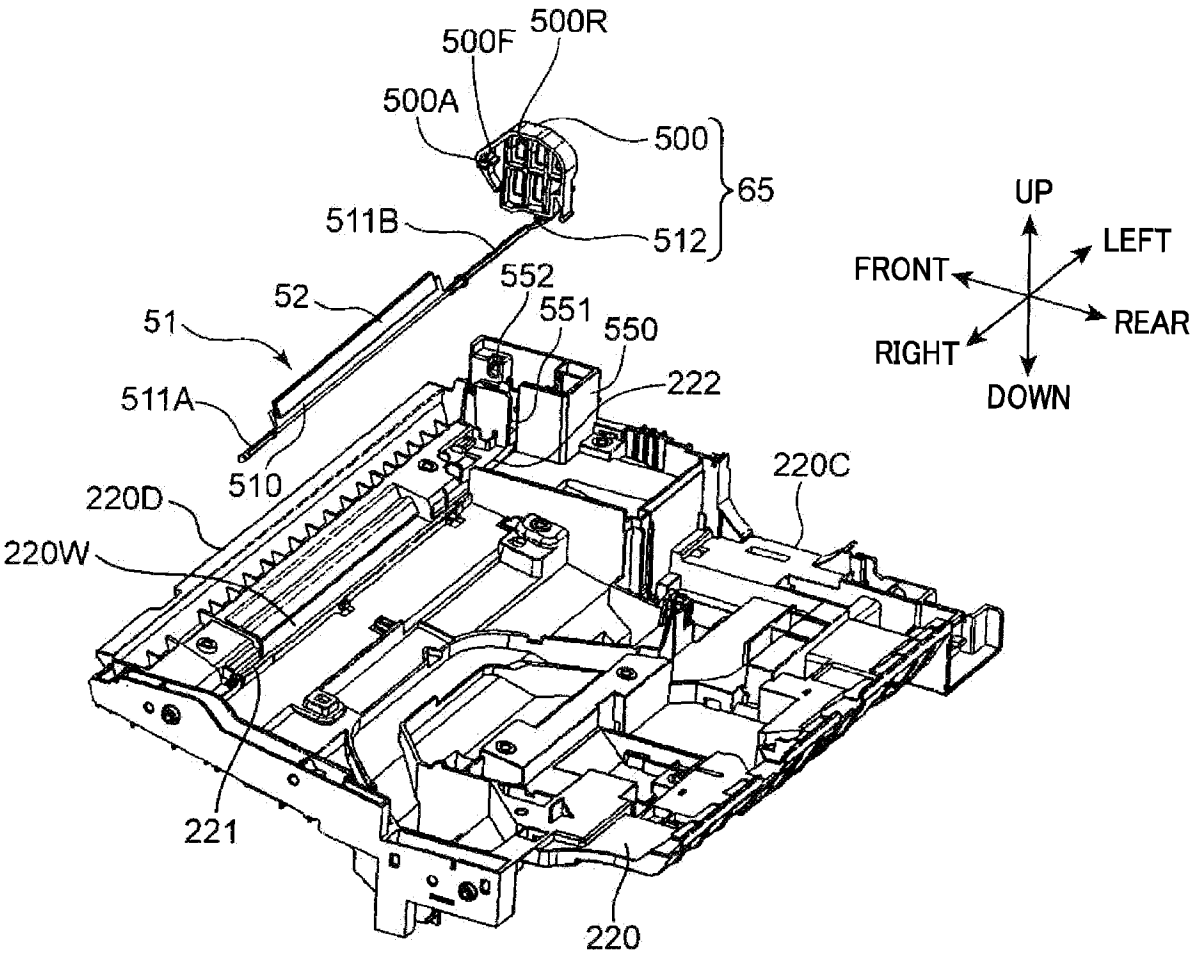
FIG. 12 is a perspective view for explaining a liaison portion according to one embodiment of the present disclosure.
Figure 13:
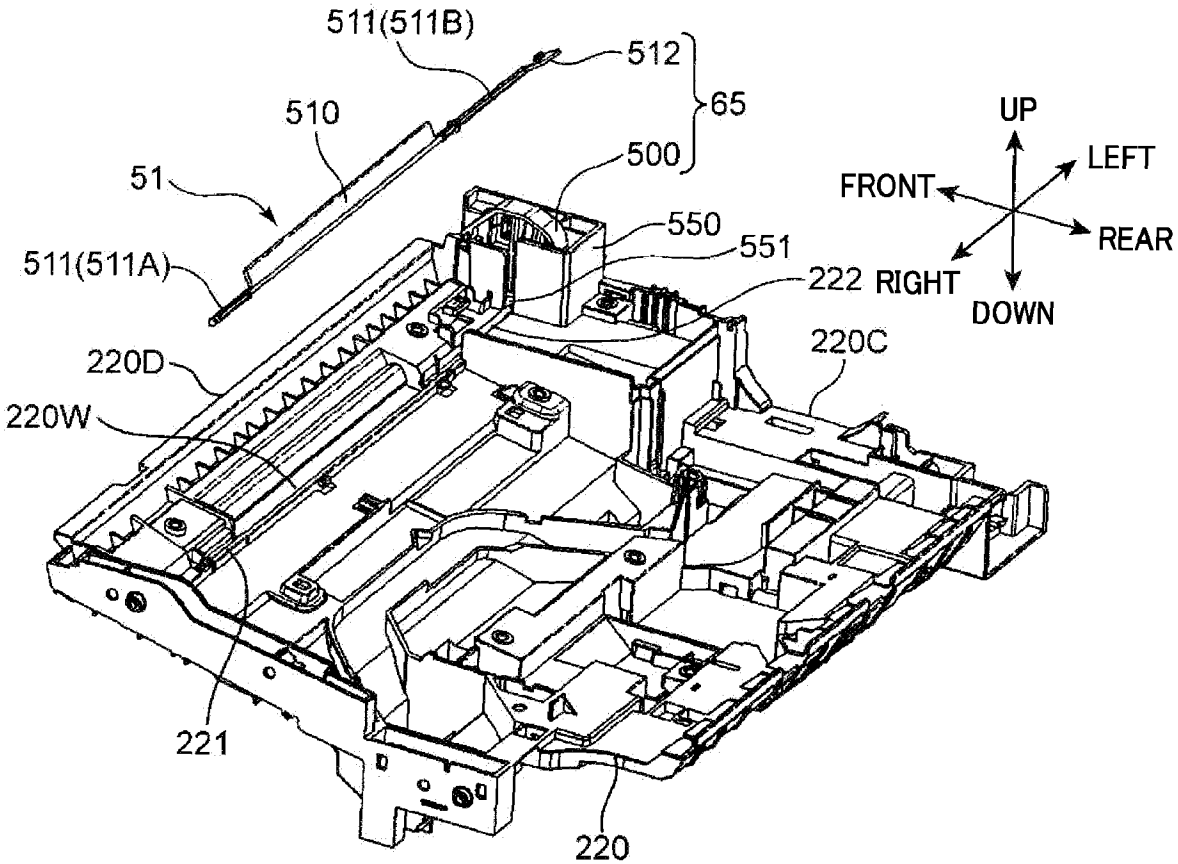
FIG. 13 is a perspective view for explaining the liaison portion according to one embodiment of the present disclosure.
Figure 14:
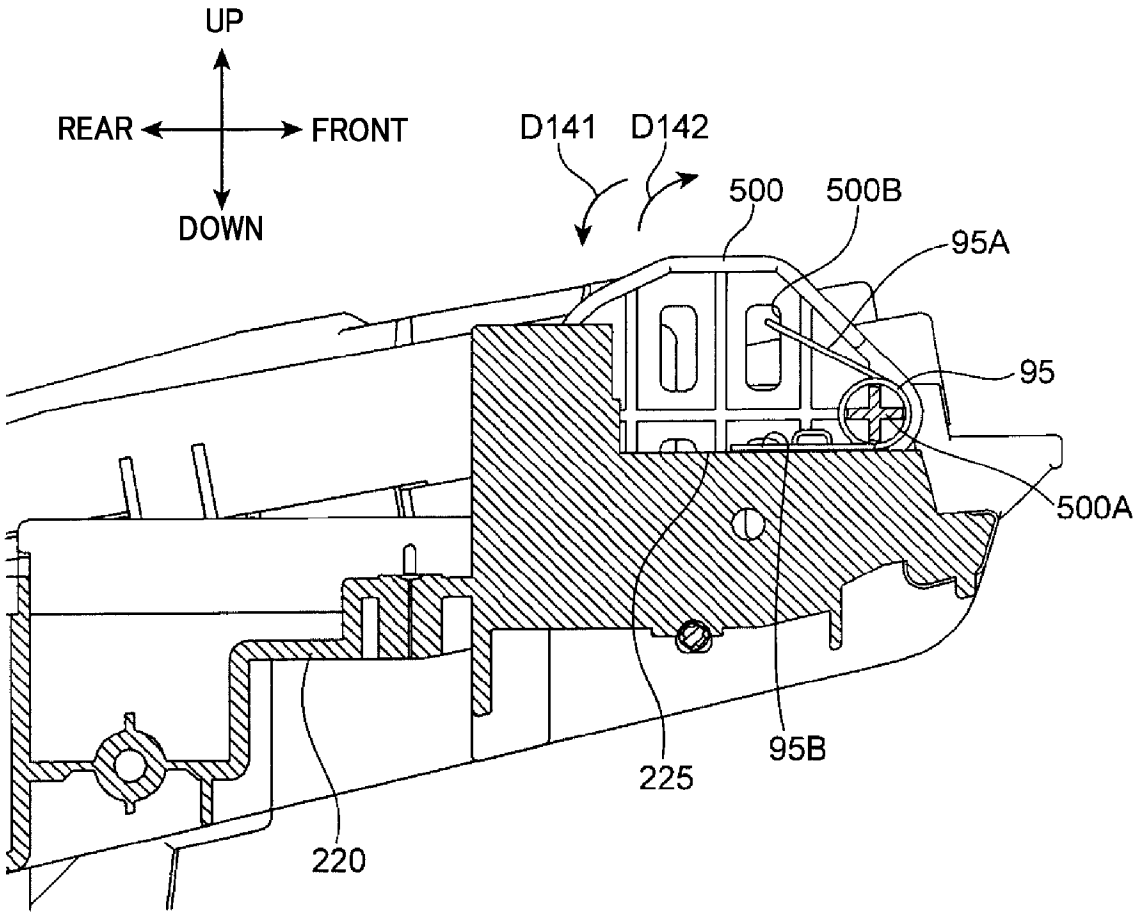
FIG. 14 is an enlarged cross sectional view of the vicinity of a link accommodating portion according to one embodiment of the present disclosure.

FIG. 11 is a perspective view showing the openable/closable cover 200C and the fitting plate 220 for explaining the interlocking mechanism 60 according to the present embodiment. FIGS. 12 and 13 are perspective views of the fitting plate 220 for explaining a liaison portion 65 composing the interlocking mechanism 60. FIG. 14 is a cross sectional view showing the state in which a link member 500 composing the liaison portion 65 is fitted to the fitting plate 220.

The interlocking mechanism 60 includes the aforementioned arm portions 230 and the aforementioned liaison portion 65 (FIGS. 12 and 13). The interlocking mechanism 60 moves the cleaning member 51 in conjunction with opening/ closing of the openable/closable cover 200C. For example, the cleaning member 51 is moved so as to slide on the surface of the seal glass 90.

The pair of arm portions 230 are arranged on the opposite sides in the right and left directions of the rear edge of the openable/closable cover 200C. Each arm portion 230 includes an arc-like curve portion 231, a hinge shaft 232, and an extension 233. One end of the curve portion 231 is connected to the rear end of an upper wall front part 205 of the openable/closable cover 200C. The extension 233 extends from the other end of the curve portion 231. The hinge shaft 232 is arranged at the extending tip end of the extension 233. The hinge shaft 232 is inserted in a hinge bearing (a pivot part, not shown) arranged in a pair-wise fashion in the outer housing 200. The hinge shaft 232 and the hinge bearing compose a hinge portion of the openable/closable cover 200C. Accordingly, the openable/closable cover 200C is turnable about each hinge shaft 232 as a pivot point. This turning achieves opening/closing of the openable/closable cover 200C.

The liaison portion 65 (FIG. 12) includes the link member 500 and a contact piece 512 in a flat plate shape.

The link member 500 includes a front part 500F substantially in a triangular shape with the foremost edge as an apex when viewed in the right and left directions and a rear part 500R substantially in a rectangular shape when viewed in the right and left directions. The rear part 500R continues from the front part 500F. At the front edge of the link member 500, a link shaft 500A is provided which protrudes in the right and left directions. Further, the link member 500 includes a contacting link part 500C, a contacted link part 500D, and an engaging claw SOOT (FIG. 15) as described below. Each of the contacting link part 500C and the contacted link part 500D forms an outer peripheral part of the link member 500. More specifically, the contacting link part 500C serves as an outer peripheral part on the lower side of the rear part 500R, while the contacted link part 500D serves as an outer peripheral part on the upper side of the front part 500F. The contacting link part 500C comes into contact with the contact piece 512, while the contacted link part 500D comes into contact with the aforementioned arm portion 230A. Further, the engaging claw 500T is a claw protruding rearward from the lower rear corner of the rear part 500R.

The contact piece 512 (FIGS. 12 and 13) is connected to the left end of the shaft 511 (the left shaft portion 511B) of the cleaning member 51. The contact piece 512 is arranged so as to be substantially orthogonal to the shielding portion 510 of the cleaning member 51 when viewed in the axial direction of the shaft 511 (the right and left directions) (FIG. 13).

It should be noted that, as shown in FIG. 13, the shielding portion 510 of the cleaning member 51 is wider than the contact piece 512 in the right and left directions, and the shielding portion 510 is heavier than the contact piece 512. For this reason, when viewed in the right and left directions, the center of gravity of the cleaning member 51 is displaced from the region where the contact piece 512 is arranged toward the region where the shielding portion 510 is arranged. Accordingly, when the cleaning member 51 connected with the contact piece 512 is fitted to a right bearing 221 and a left bearing 222 of the fitting plate 220, the shielding portion 510 is turned frontward by the weight of the cleaning member 51 so as to block the opening 220W. Simultaneously, the contact piece 512 is arranged so as to extend substantially upward.

Figure 15:
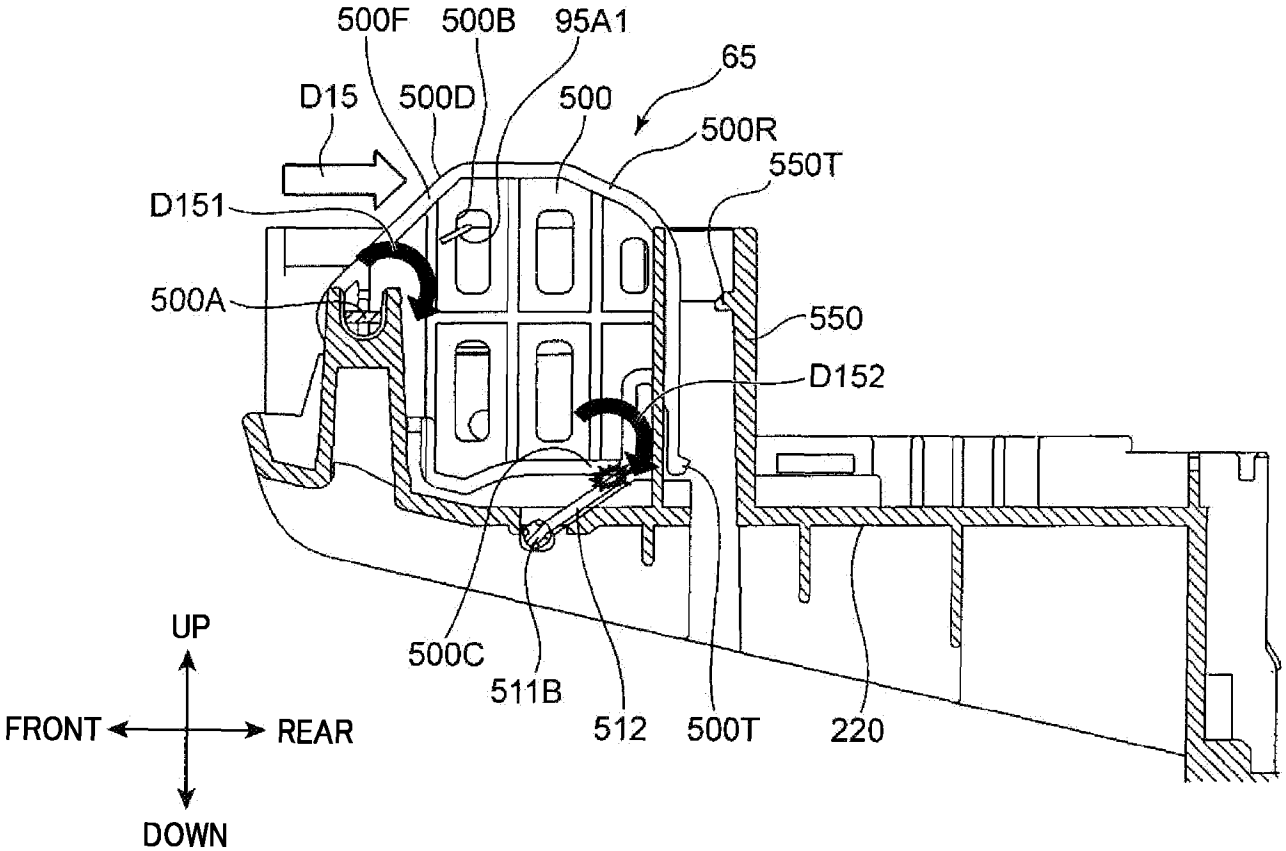
FIG. 15 is a diagram for explaining movement of a link member according to one embodiment of the present disclosure.

Moreover, the fitting plate 220 includes a link accommodating portion 550 at the corner where the plate left wall 220C meets the plate front wall 220D. The link accommodating portion 550 is in a box shape with a plurality of walls standing on the front, rear, right, and left sides. The link accommodating portion 550 is open upward. In the right side wall of the link accommodating portion 550, a slit 551 with a slim width in the front-rear direction is formed in the vertical direction. Further, a substantially cylindrical bearing 552 is provided inside the left side wall of the link accommodating portion 550 (FIG. 12). The bearing 552 extends in the right and left directions. Moreover, an engaging protrusion 550T is formed on the inner surface of the rear wall of the link accommodating portion 550 (FIG. 15). The engaging protrusion 550T is a protrusion protruding frontward from the inner surface of the rear wall.

Referring to FIGS. 11-13, the right shaft portion 511A and the left shaft portion 511B of the cleaning member 51 are fitted to a right bearing 221 and a left bearing 222 of the fitting plate 220, respectively. In this fitting, the left end part of the left shaft portion 511B is inserted in the slit 551 of the link accommodating portion 550 from above, while the contact piece 512 is inserted in the link accommodating portion 550. Further, the link shaft 500A of the link member 500 is fitted in the bearing 552 of the link accommodating portion 550, so that the link member 500 is accommodated in the link accommodating portion 550. Thus, the link member 500 is turnable in the vertical direction about the link shaft 500A as a pivot point. It is noted that when the link member 500 is accommodated in the link accommodating portion 550, the lower end part of the link member 500 (the contacting link part 500C, FIG. 15) pushes the contact piece 512 inserted earlier in the link accommodating portion 550 from above.

Referring further to FIG. 14, a spring 95 (an urging member) is provided at the link shaft 500A of the link member 500. The spring 95 is generally called a torsion spring. The spring 95 is formed in such a fashion that from a coil part formed of a wound wire, a latch part 95A as one end part of the wire and a contact part 95B as the other end part of the wire protrude. Further, the latch part 95A and the contact part 95B are arranged apart from each other with a predetermined distance left in the peripheral direction of the coil part. In the state in which the link shaft 500A is inserted through the coil part of the spring 95, a tip end part 95A1 of the latch part 95A is bent and is latched at a side wall 500B with an opening formed in the link member 500 (FIGS. 14 and 15). By contrast, the contact part 95B of the spring 95 is in contact with a contact surface 225. The contact surface 225 is the surface of the wall part of the fitting plate 220. In FIG. 14, when the link member 500 is turned about the link shaft 500A as a pivot in the direction indicated by the arrow D141 (downward), the distance between the latch part 95A and the contact part 95B of the spring 95 is reduced, thereby resiliently deforming the spring 95 to store resilient energy in the spring 95.

Figure 16:
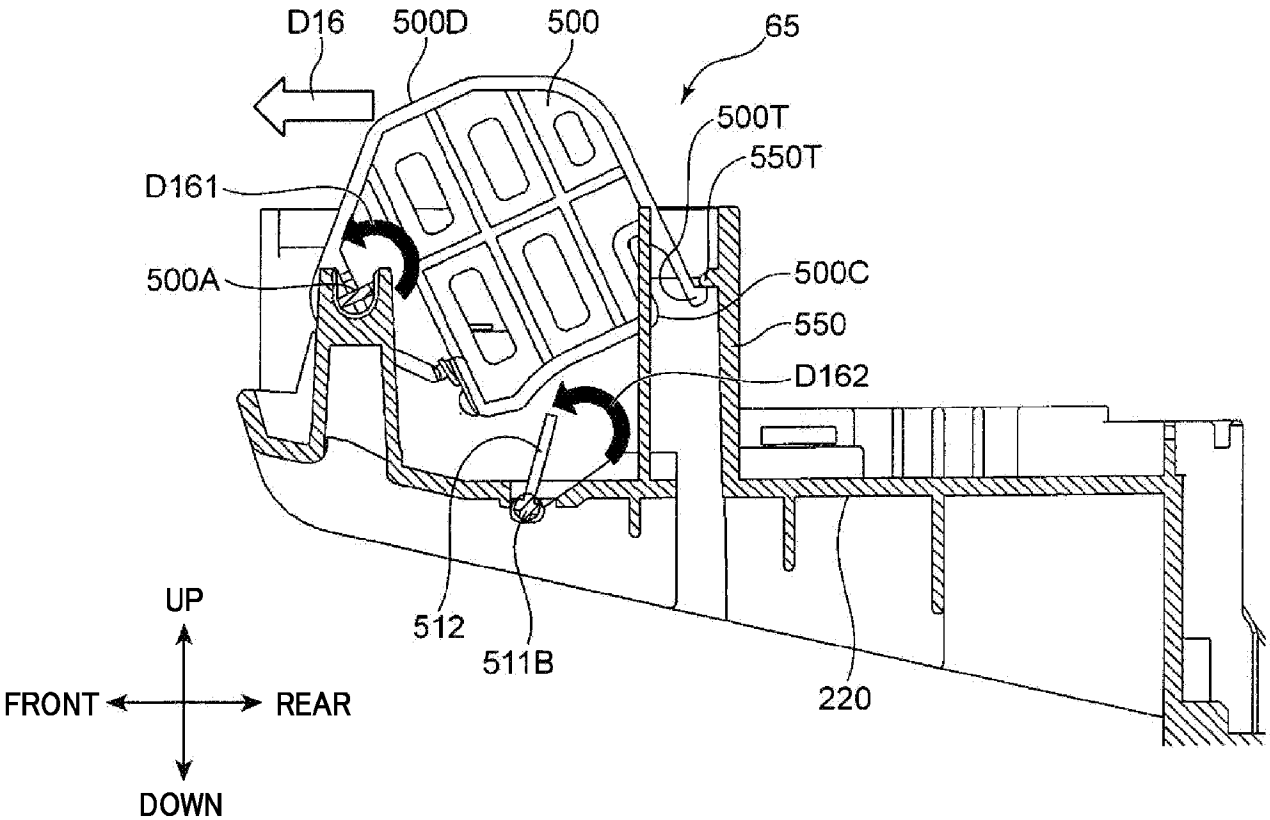
FIG. 16 is a diagram for explaining movement of the link member according to one embodiment of the present disclosure.

With reference to FIGS. 15 and 16, in addition to FIGS. 1, 2, and 9-14, description will be made next about movement of the cleaning member 51 in conjunction with opening/closing of the openable/closable cover 200C. FIGS. 15 and 16 are cross sectional views showing the vicinity of the link member 500 for explaining the movement of the link member 500.

When the openable/closable cover 200C is closed as shown in FIG. 1, the curve portion 231 of the arm portion 230A (FIG. 11) pushes the contacted link part 500D of the link member 500 rearward (in the direction indicated by the arrow D15 in FIG. 15). Accordingly, the link member 500 is turned in the direction indicted by the arrow D151 in FIG. 15, so that the spring 95 is resiliently deformed to reduce the distance between the latch part 95A and the contact part 95B from the predetermined distance. Further, the contacting link part 500C of the link member 500 pushes the contact piece 512 downward (in the direction indicted by the arrow D152 in FIG. 15).

In the state when the openable/closable cover 200C is closed, the cleaning member 51 is set at the first position as shown in FIG. 9.

As described above, when the openable/closable cover 200C is closed at the outer housing 200, the tip end portion 521 of the cleaning sheet 52 of the cleaning member 51 is positioned outside the rear end of the to-be-cleaned region CA, as shown in FIG. 9. Further, the cleaning member 51 is positioned rearwardly apart from the light path L of the laser light coming out from the emission part BA of the seal glass 90. Accordingly, when the openable/closable cover 200C is closed, the laser light can come out from the emission part BA of the seal glass 90 to be irradiated to the photosensitive drum 121 through the opening 220W.

By contrast, when the openable/closable cover 200C is opened (is moved) so that the state shown in FIG. 1 is changed to the state shown in FIG. 2, the curve portion 231 of the arm portion 230A separates from the contacted link part 500D of the link member 500. As a result, the resilient energy of the spring 95 is released (in the direction indicated by the arrow D142 in FIG. 14) to turn the link member 500 in the direction indicated by the arrow D161 in FIG. 16. In conjunction with the turning of the link member 500, the contacting link part 500c of the link member 500 separates from the contact piece 512. Then, the engaging claw 500T of the link member 500 engages with the engaging protrusion 550T of the link accommodating portion 550 to stop the turning of the link member 500 in the direction indicated by the arrow D161. When the link member 500 separates from the contact piece 512, movement of the cleaning member 51 connected to the contact piece 512 by its own weight turns the contact piece 512 in the direction indicated by the arrow D162 in FIG. 16, as described above. Simultaneously, the cleaning member 51 is turned in the direction indicated by the arrow D101 in FIG. 10 (a first direction). At this time, the tip end portion 521 of the cleaning sheet 52 of the cleaning member 51 slides on the to-be-cleaned region CA of the seal glass 90, as described above. Thus, the emission part BA of the seal glass 90 is cleaned favorably.

Thereafter, as shown in FIG. 2, when the openable/closable cover 200C is opened fully, the cleaning member 51 is set at the second position, as shown in FIG. 10. Then, the shielding portion 510 of the cleaning member 51 set at the second position shields the light path L of the laser light coming out from the emission part BA of the seal glass 90. Accordingly, in the state when the openable/closable cover 200C is opened so that the user can see the main body interior space 260, even if the laser light is irradiated from the exposure device 123 in error, the shielding portion 510 of the cleaning member 51 can shield the laser light. Thus, the laser light is prevented from entering the user's eyes in error.

When the openable/closable cover 200C is moved so as to be in the closed state shown in FIG. 1, similarly to above, the curve portion 231 of the arm portion 230A pushes the contacted link part 500D of the link member 500 (in the direction indicated by the arrow D15 in FIG. 15). Then, in conjunction with the turning of the link member 500, the contacting link part 500C of the link member 500 pushes and turns the contact piece 512 (in the direction indicated by the arrow D152 in FIG. 15). At the same time, the shaft 511 of the cleaning member 51 is rotated in a second direction (the direction indicated by the arrow D102 in FIG. 10) opposite to the first direction to move the cleaning member 51 from the first position to the second position.

Thus, according to the above embodiment, the openable/closable cover 200C is arranged so as to open/close the outer housing 200 in which the main body interior space 260 is formed. The exposure device 123 is disposed in the main body interior space 260. The exposure device 123 includes the laser diode 81 configured to output the laser light, the housing 80, and the seal glass 90 configured to cover the emission opening 850 and to transmit the laser light. The emission opening 850 opens at the bottom portion 80S of the housing 80 to allow the laser light to come out therefrom. Further, the cleaning member 51 slides on the surface of the seal glass 90 from which the transmitted laser light comes out (i.e., the surface of the seal glass 90 corresponding to the outer surface of the housing 80), thereby cleaning the seal glass 90.

In particular, the cleaning member 51 is moved from the first position (a non-shielding position), where the light path L of the laser light passing through the seal glass 90 is not shielded, to slide on the to-be-cleaned region CA including the emission part BA from which the laser light passing through the seal glass 90 comes out, and reaches then the second position where the light path L is shielded. Further, in conjunction with opening/closing of the openable/closable cover 200C, the interlocking mechanism 60 moves the cleaning member 51 between the first position and the second position. Accordingly, there is no need of providing any driving means, such as a drive motor, in order for the cleaning member 51 to clean the seal glass 90. Thus, the printer 100 can be reduced in size by space in which the driving means, such as a drive motor is provided.

Furthermore, according to the above embodiment, the cleaning member 51 is set at the second position to shield the light path L of the laser light coming out from the emission part BA of the seal glass 90. Accordingly, the cleaning member 51 that cleans the seal glass 90 can serve as also a shielding member to shield the light path L of the laser light.

Moreover, according to the above embodiment, the cleaning member 51 includes the shielding portion 510, the cleaning sheet 52, and the shaft 511. The shielding portion 510 is in a plate shape extending in the direction intersecting with the seal glass 90 at the first position. The cleaning sheet 52 is arranged at the shielding portion 510 and extends toward the seal glass 90. The shaft 511 is arranged at a part of the shielding portion 510 which is opposite to the seal glass 90. In addition, the interlocking mechanism 60 allows the shielding portion 510 at the first position to turn about the shaft 511 in the first direction according to change in the state of the openable/closable cover 200C from the closed state to the opened state, thereby allowing the tip end portion 521 of the cleaning sheet 52 to slide on the surface of the seal glass 90 (the to-be-cleaned region CA). Accordingly, the turning of the cleaning member 51 about the shaft 511 can accompany movement of the cleaning member 51 from the first position to the second position, thereby achieving cleaning of the seal glass 90.

Yet further, according to the above embodiment, the cleaning sheet 52 is formed of a flexible elastic member, such as a urethane sheet. Accordingly, in conjunction with turning of the cleaning member 51, the cleaning sheet 52 can be elastically deformed so as to be kept in contact with the surface of the seal glass 90.

Still further, according to the above embodiment, the outer housing 200 includes the pivot parts that turnably support the openable/closable cover 200C. The openable/closable cover 200C is turned about the pivot parts to be freely opened/closed. Moreover, the openable/closable cover 200C includes the arm portions 230 which enter the main body interior space 260 in conjunction with change from the opened state to the closed state. Further, the liaison portion 65 of the interlocking mechanism 60 is connected to the shaft 511 of the cleaning member 51. The liaison portion 65 comes into contact with the arm portions 230 entering the main body interior space 260 to rotate the shaft 511 in the second direction, thereby moving the cleaning member 51 from the second position to the first position. Thus, the arm portions 230 and the liaison portion 65 move the cleaning member 51 from the second position to the first position.

Further, according to the above embodiment, the liaison portion 65 includes the link member 500, the contact piece 512, and the spring 95. The link member 500 is arranged at the outer housing 200 (the fitting plate 220), comes into contact with the arm portion 230A, and is turnable. The contact piece 512 is connected to the shaft 511 of the cleaning member 51 and is capable of coming into contact with the link member 500. The spring 95 urges the link member 500 so as to separate it from the contact piece 512. In conjunction with change from the opened state to the closed state of the openable/closable cover 200C, the arm portion 230A turns the link member 500 urged by the spring 95 toward the contact piece 512, so that the link member 500 comes into contact with the contact piece 512 to turn the shaft 511 of the cleaning member 51 in the second direction. Thus, the arm portion 230A, the link member 500, the contact piece 512, and the spring 95 move the cleaning member 51 from the second position to the first position.

Moreover, according to the above embodiment, in the state in which the contact piece 512 is out of contact with the link member 500, the cleaning member 51 is set at the second position by its own weight. Accordingly, in changing the closed state to the opened state of the openable/closable cover 200C, when the arm portions 230 get out from the main body interior space 260, and the link member 500 separates from the contact piece 512, the cleaning member 51 moves by its own weight from the second position to the first position. Thus, the cleaning sheet 52 is allowed by the weight of the cleaning member 51 to be in contact with the surface of the seal glass 90.

The exposure device 123 and the printer 100 (the image forming apparatus) including it according to the embodiment of the present disclosure have been described above, but do not limit the present disclosure. Various modifications may be possible as follows, for example.

(1) The above embodiment has been described in which the cleaning member 51 shields the light path of the laser light at the second position. However, the present disclosure is not limited to the embodiment. The cleaning member 51 may have only a function of cleaning a region including the emission part BA of the seal glass 90.

(2) Further, the above embodiment has been described in which the interlocking mechanism 60 includes the arm portion 230A and the liaison portion 65 in order for the cleaning member 51 to slide on the surface of the seal glass 90. However, the present disclosure is not limited to the embodiment. In conjunction with opening/closing of the openable/closable cover 200C, the cleaning member 51 may be moved so as to be in contact with the surface of the seal glass 90. Further, the liaison portion 65 according to the present disclosure is not limited to that composed of the link member 500, the contact piece 512, and the spring 95. The liaison portion 65 may dispense with the link member 500. In this case, a spring member (not shown) urges the contact piece 512 so that the cleaning member 51 is set at the second position. In conjunction with change from the opened state to the closed state of the openable/closable cover 200C, the arm portion 230A directly comes into contact with the contact piece 512 to move the cleaning member 51 from the second position to the first position.

(3) Moreover, the above embodiment has been described in which the cleaning member 51 is set at the second position by its own weight in the opened state of the openable/closable cover 200C. However, the present disclosure is not limited to the embodiment. The cleaning member 51 may be set at the second position by urging the cleaning member 51 by a spring not shown.

(4) In addition, the above embodiment has been described in which the cleaning sheet 52 of the cleaning member 51 is in contact with the surface of the seal glass 90 at the first position and the second position. However, the present disclosure is not limited to the embodiment. The cleaning sheet 52 may separate from the surface of the seal glass 90 at the first position or the second position. Even in this case, where the cleaning sheet 52 is configured to slide on the to-be-cleaned region CA during the time when the cleaning member 51 is moved between the first position and the second position, the seal glass 90 can be cleaned favorably.

What is claimed is:

1. An image forming apparatus, comprising:

an outer housing;

a cover openably/closably mounted at the outer housing;

an optical scanning device including a light transmissive member configured to transmit laser light;

a cleaning member configured to clean the light transmissive member; and an interlocking mechanism configured to move the cleaning member in conjunction with opening/closing of the cover, wherein in conjunction with change from a closed state to an opened state of the cover, the interlocking mechanism allows the cleaning member to move from a first position where a light path of the laser light passing through the light transmissive member is not shielded to a second position where the light path of the laser light is shielded, while allowing the cleaning member to slide on a surface of the light transmissive member, the cleaning member includes:

a plate-shaped support member extending in a direction intersecting with the light transmissive member at the first position;

a sheet member provided at the support member and extending toward the light transmissive member; and a shaft arranged at a part of the support member which is opposite to the light transmissive member, and according to the change from the closed state to the opened state of the cover, the interlocking mechanism turns the support member about the shaft in a first direction to allow a tip end of the sheet member in a direction where the sheet member extends to slide on the surface of the light transmissive member from the first position to the second position.

2. The image forming apparatus of claim 1, wherein the sheet member is formed of a flexible elastic member.

3. The image forming apparatus of claim 1, wherein the outer housing includes a pivot part configured to turnably support the cover, the cover is turned about the pivot part to be openable/closable and includes an arm portion which enters an interior space of the outer cover in conjunction with change from the opened state to the closed state, and the interlocking mechanism includes a liaison portion connected to the shaft of the cleaning member and configured to come into contact with the arm portion when the arm portion enters the interior space of the outer housing to rotate the shaft in a second direction opposite to the first direction so that the cleaning member is moved from the second position to the first position.

4. The image forming apparatus of claim 3, wherein the liaison portion includes:

a link member which is provided at the housing and is configured to come into contact with the arm portion and to be turnable;

a contact piece which is connected to the shaft of the cleaning member and is capable of coming into contact with the link member; and an urging member configured to urge the link member so as to separate the link member from the contact piece, wherein in conjunction with the change from the opened state to the closed state of the cover, the arm portion turns the link member urged by the urging member toward the contact piece to allow the link member to come into contact with the contact piece so that the shaft of the cleaning member is rotated in the second direction.

5. The image forming apparatus of claim 4, wherein in a state in which the contact piece is out of contact with the link member, the cleaning member is set at the second position by its own weight.

* * * * *